United States Patent [19]

Gray

[11] Patent Number: 4,534,543

[45] Date of Patent: Aug. 13, 1985

[54] METHOD OF ELEVATING A FOUR WHEEL VEHICLE UTILIZING A TILTABLE SUPPORT STAND

[75] Inventor: Joseph L. Gray, St. Joseph, Mo.

[73] Assignee: Gray Manufacturing Company, Inc., St. Joseph, Mo.

[21] Appl. No.: 503,702

[22] Filed: Jun. 13, 1983

Related U.S. Application Data

[62] Division of Ser. No. 261,612, May 8, 1981, abandoned.

[51] Int. Cl.[3] ..... B66F 3/00

[52] U.S. Cl. ..... 254/1; 254/134

[58] Field of Search ..... 269/296; 254/1, 94, 254/2 B, 133, 134; 248/352, 357, 351, 354, 346, 670, 188.1; 182/214, 107, 129; 297/232; 414/678

[56] References Cited

U.S. PATENT DOCUMENTS

| | | | |
|---|---|---|---|
| 1,850,905 | 3/1932 | Zimmerman | 254/94 |
| 2,606,735 | 8/1952 | Zembrosky et al. | 248/352 |
| 2,903,258 | 9/1959 | Jovanovich | 269/296 |
| 3,252,590 | 5/1966 | Nielsen | 254/126 |
| 3,761,058 | 9/1973 | Stone et al. | 254/94 |

*Primary Examiner*—Robert C. Watson

*Attorney, Agent, or Firm*—Schmidt, Johnson, Hovey & Williams

[57] ABSTRACT

A low cost, tiltable vehicle support stand is provided which is inherently stable in use and is designed to develop a righting moment during vehicle setup operations so that a vehicle can be quickly and easily elevated to facilitate work thereon. The preferred support stand includes a relatively wide base having an elongated, transversely extending beam secured thereto; a pair of padded vehicle-engaging members are shiftably mounted on the beam and are spaced apart a distance greater than the effective width of the base. In this manner the center of gravity of a supported vehicle lies in a plane which passes between the lateral side margins of the base, even in the event that the stand or vehicle-engaging members are located asymmetrically relative to the underside of the vehicle. This stand configuration also ensures that the vehicle and stand will right themselves during initial setup, which genrally involves sideways elevation and tilting of the vehicle, placing a pair of the support stands beneath the vehicle in a similarly tilted orientation, and lowering the vehicle to effect reverse tilting of the vehicle and stands until the same are righted and the vehicle is elevated.

2 Claims, 12 Drawing Figures

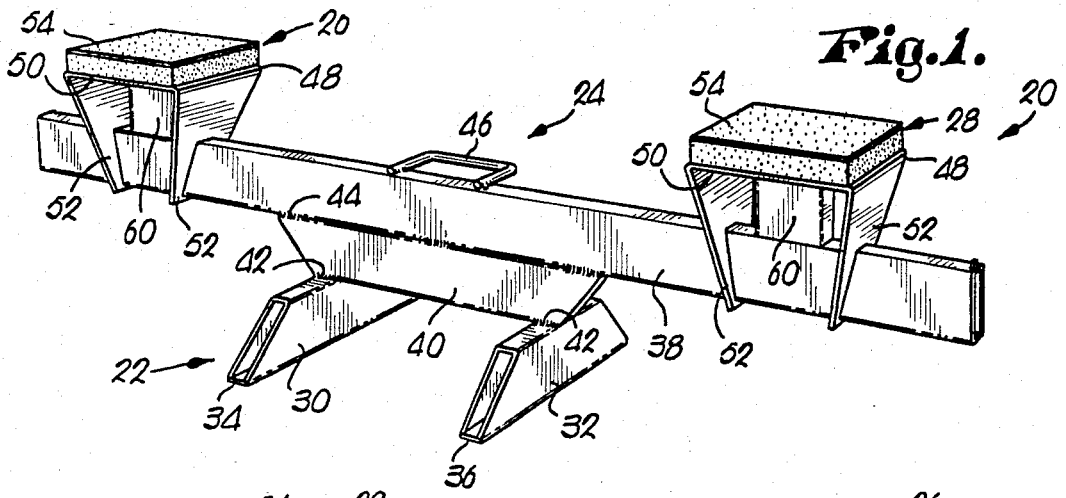
Fig.1.
Fig.2.
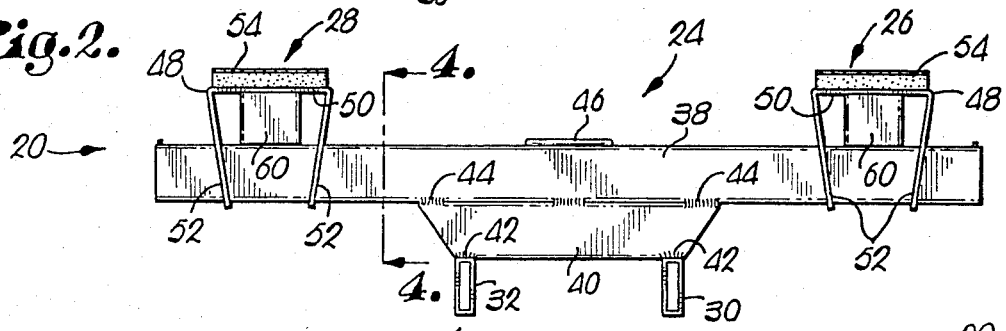
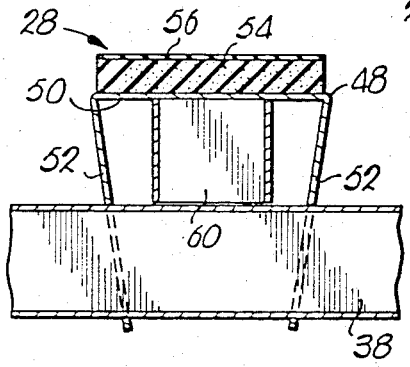
Fig.5.
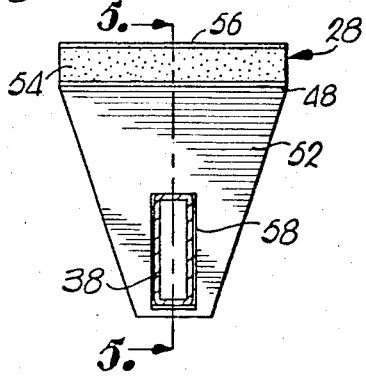
Fig.4.
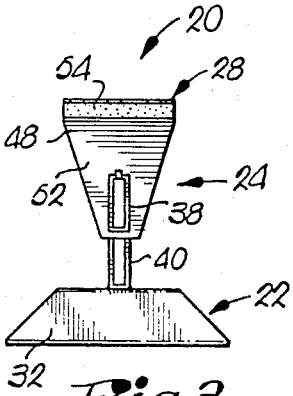
Fig.3.
Fig.7.
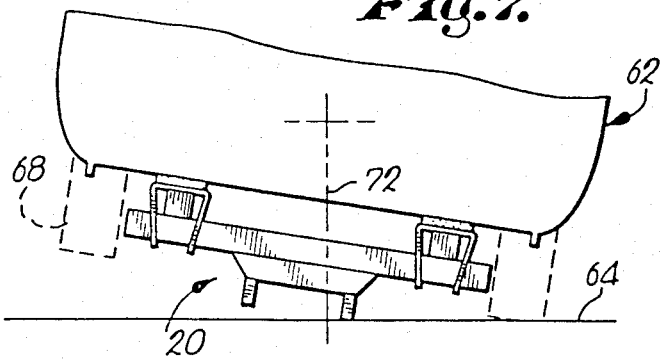
Fig.6.
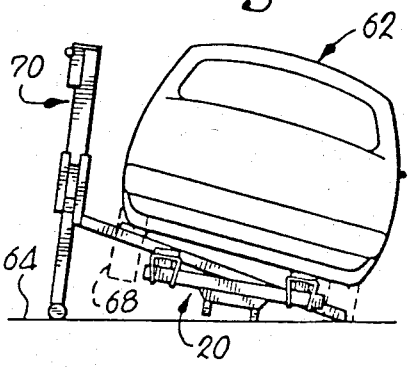

METHOD OF ELEVATING A FOUR WHEEL VEHICLE UTILIZING A TILTABLE SUPPORT STAND

This is a division of application Ser. No. 06/261,612 filed on May 8, 1981 now abandoned.

BACKGROUND OF THE INVENTION

1. Field of the Invention

The present invention is broadly concerned with an improved, tiltable vehicle support stand, and a corresponding method, which greatly facilitates work on and around four wheel vehicles. More particularly, it is concerned with such a support stand which is especially designed to be particularly stable during use thereof, and which can be used to set up a vehicle without the usual time-consuming procedures of conventional supports.

2. Description of the Prior Art

Automobile repair shops and others many times need to elevate vehicles a short distance off the ground in order to facilitate various repairs and servicing. For example, tire changes and certain work beneath the vehicle (usually done with the aid of a low profile dolly) require that the vehicle be elevated off a shop floor.

The conventional practice in this regard is to initially elevate the front, rear or one side of the vehicle using an end lift or service jack, followed by positioning of a pair of individual stands under the elevated part of the vehicle adjacent the elevated wheels. This procedure is then repeated on the opposite end or side of the vehicle in order to completely elevate the latter off the shop floor. A number of problems arise in connection with this conventional procedure. Governmental regulations generally require positioning of stands under a vehicle as safety devices, even if the jack used to lift the vehicle is left in place. To be effective though, they must be properly located and adjusted to positions just below the overlying structure. But, because of the trouble in locating and positioning the stands, mechanics often ignore the safety aspects of the stands in favor of saving time and simply leave the vehicle on the jack or jacks without underlying stands. When stands are used to support the vehicle so the jack or jacks can be used elsewhere, the individual support stands must be even more carefully placed beneath the vehicle in order to ensure that the vehicle is evenly supported. In addition, the effective heights of the support stands must be precisely adjusted so that the vehicle is stable in its elevated position, particularly if the shop floor is uneven. It will also be appreciated that these steps of positioning and adjustment of the respective stands must be performed from a rather awkward position adjacent or beneath the vehicle. Hence, support of a vehicle in an elevated position using conventional stands has proven to be a time-consuming and sometimes difficult task.

SUMMARY OF THE INVENTION

The vehicle support stand of the present invention broadly includes a base adapted to rest on a floor and which presents a pair of laterally spaced apart, floor-engaging side margins. Structure defining a pair of laterally spaced apart vehicle-engaging support regions is secured atop the base with the regions above the floor. Further, the vehicle-engaging regions are spaced apart a distance greater than the lateral distance between the base side margins.

In preferred forms, the base comprises a pair of elongated, separate, laterally spaced apart foot members formed of metallic tube stock, with an elongated, transversely extending beam being rigidly connected to the foot members. The beam supports a pair of relatively shiftable upstanding bodies of inverted, generally U-shaped configuration. A resilient friction pad is affixed to the upper face of each U-shaped body, whereas the depending legs thereof are apertured and slidably receive the beam. The support stand is of relatively low profile, and is especially designed to develop a righting moment during vehicle setup operations, and to be exceptionally stable in use. To this end, the distance between the side margins of the base, the distance between the spaced-apart vehicle-engaging support regions, and the height of the regions above the floor, are correlated such that the center of gravity of a supported vehicle lies in a plane passing between the base side margins. Further, when the vehicle is elevated and thereby tilted sideways during setup operations with the tires on one side of the vehicle engaging a floor, and a pair of support stands are placed under the sideways tilted vehicle similarly tilted, the center of gravity of the vehicle again lies in a plane which passes between the base side margins. In this fashion a righting moment is developed which urges the stands and vehicle back toward their fully righted positions.

Use of a jack which raises one side of a vehicle and insertion of tiltable support stands as disclosed herein has a number of further important advantages. It solves the problem of meeting governmental regulations requiring stands because mechanics will not leave the vehicle in a tilted position when all four wheels must be raised off the ground yet they need not position stands, then walk around to the opposite side or end of the vehicle, again raise the same and position more stands. Of significance in this respect is the fact that no more than two stands are ever required and they need not be adjusted vertically or as precisely under the vehicle as conventional stands.

BRIEF DESCRIPTION OF THE DRAWINGS

FIG. 1 is a perspective view of a vehicle support stand in accordance with the invention;

FIG. 2 is a rear elevational view of the stand illustrated in FIG. 1;

FIG. 3 is an end elevational view of the stand depicted in FIGS. 1–2;

FIG. 4 is a sectional view taken along line 4—4 of FIG. 2;

FIG. 5 is a sectional view taken along line 5—5 of FIG. 4;

FIG. 6 is an end view illustrating initial setup operations with the support stands of the present invention and an elevated and sideways vehicle;

FIG. 7 is an end view similar to that of FIG. 6 but illustrates the stands and vehicle during righting of the same;

DESCRIPTION OF THE PREFERRED EMBODIMENT

Figure 9:
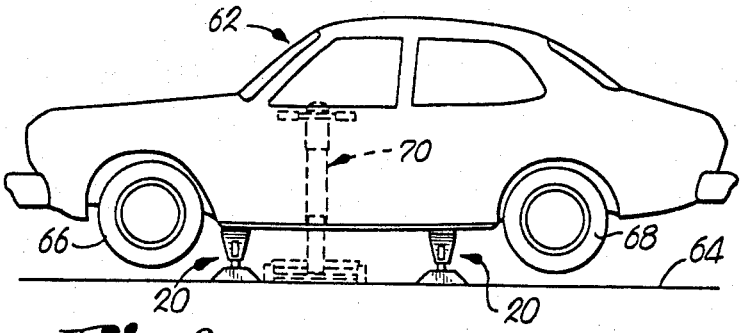
FIG. 9 is a side elevational view of the fully elevated vehicle depicted in FIG. 8, with a tilting jack being illustrated in phantom and located between the fore and aft vehicle supports in accordance with the invention.
Figure 8:
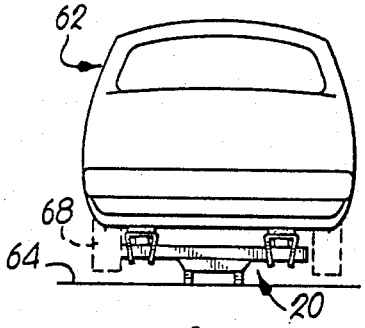
FIG. 8 is a view similar to that of FIG. 6, but illustrates the stands and vehicle fully righted with the vehicle elevated off the floor.

Turning now to the drawings, a vehicle support stand 20 is illustrated in FIGS. 1–3. The stand 20 includes a floor-engaging base 22, structure broadly referred to by the numeral 24 which defines a pair of laterally spaced apart vehicle-engaging and supporting regions 26, 28, and means such as welding which secures the structure 24 to the base 22 with the regions 26, 28 being located above the floor.

In more detail, the base 22 preferably includes a pair of laterally spaced apart tubular metallic feet 30, 32. The feet 30, 32 present corresponding floor-engaging side margins 34, 36, which in turn define the lateral extremities of the base.

The structure 24 includes an elongated, transversely extending, metallic tubular beam member 38 of rectangular cross section which is connected to the feet 30, 32 through a short connection beam 40 and appropriate welds 42, 44. A handle 46 is welded to the upper face of beam member 38 between the feet 30, 32 and projects rearwardly from the beam 38 as viewed in FIG. 1.

The vehicle-engaging regions 26, 28 are identical and each include an upstanding body 48 of inverted, generally U-shaped configuration. Each body 48 includes a planar, uppermost bight portion 50 and spaced apart, depending, converging leg plates 52. A resilient pad 54 is secured to the upper face of each bight 50, and is comprised of a relatively dense foam rubber element and an overlying neoprene rubber impregnated fiberglass sheet 56 (see FIG. 5). The sheet 56 provides an anti-slip surface in order to facilitate placement and use of the stand 20 beneath a vehicle.

The arms 52 are apertured as at 58 and slidably receive the beam 38. In this connection, the apertures 58 are dimensioned relative to beam 38 so that the bodies 48 can be laterally shifted along the length of the beam by grasping one leg 52 and pulling the entire body. However, if it is attempted to shift the body 48 by applying a pushing force against one of the legs 52, the legs frictionally bind against the beam 38 and prevent such movement.

In preferred forms, each body 48 further includes a depending reinforcing member 60 which is welded to the underside of bight 50 and extends to a point closely adjacent the upper surface of beam 38. The member 60 is preferably formed of rectangular tubular metallic stock identical to that used in forming the beams 38, 40 and feet 30, 32.

FIGS. 6–9 illustrate the use of a pair of stands 20 for elevating a vehicle 62 off a floor 64. The vehicle 62 is a small automobile having front and rear wheels 66, 68.

The first step in the method involves elevation and sideways tilting of vehicle 62 such that the tires on one side thereof engage floor 64 and the tires on the opposite side of the vehicle are elevated. Such sideways tilting of vehicle 62 can most preferably be accomplished through use of an improved side lift jack 70 which is placed between the front and rear wheels 66, 68 as viewed in FIGS. 6 and 9. The jack 70 is fully described in pending application for U.S. Letters Patent entitled "Side Life Jack for Unibody Automobiles", Ser. No. 241,436, Filed: March 6, 1981 now U.S. Pat. No. 4,379,545. This application is expressly incorporated by reference herein.

The next step of the method involves placing a pair of vehicle supports 20 beneath the tilted vehicle 62. Specifically, the supports 20 are individually slid beneath vehicle 62 from a point adjacent the elevated side of the vehicle, whereupon the adjacent end of the beam 38 is elevated and the remote vehicle-engaging pad 54 is wedged into contact with the underside of the vehicle at a point closely adjacent the floor-engaged tires thereof. This has the effect of holding the stand in an elevated and tilted orientation (see FIG. 6) similar to that of the vehicle 62.

The jack 70 is next lowered, which causes the vehicle 62 to become righted by reverse movement of the vehicle and support stands until both feet of the latter firmly engage floor 64. This action is illustrated in FIG. 7. In addition, FIG. 7 includes a line 72 which represents the center of gravity of the vehicle 62. In this connection, it will be seen that center of gravity line 72 lies in a plane which passes between the side margins 34, 36 of the bases 22 of the supports 20. Hence, a righting moment is established when the vehicle and stand are in their tilted orientation and jack 70 is lowered. This serves to induce the reverse movement as described and facilitates final elevation of the vehicle 62 above the floor on the stand 20.

Figure 10:
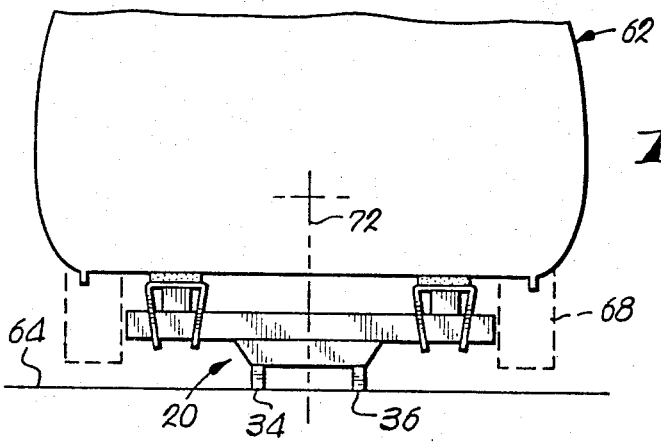
FIG. 10 is an enlarged view similar to that of FIG. 8 and illustrates the preferred relationship of the center of gravity of the vehicle to the support stand.
Figure 11:
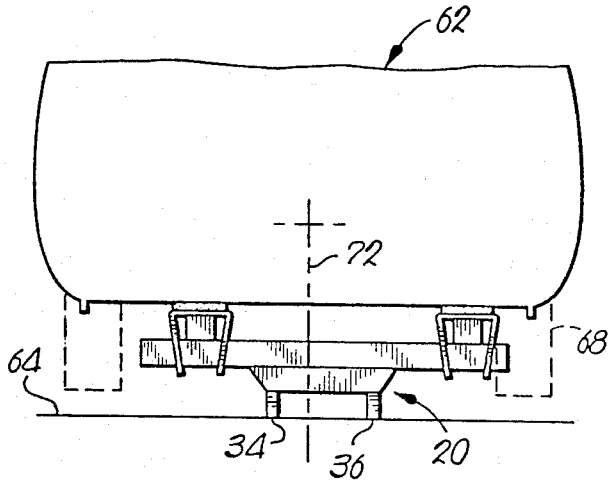
FIG. 11 is a view similar to that of FIG. 10, but illustrates the support stand asymmetrically oriented beneath the vehicle while nevertheless maintaining the desired relationship of the vehicle center of gravity relative to the stand.

FIGS. 10 and 11 depict vehicle 62 in its fully elevated position. In the case of FIG. 10, the stands 20 are essentially symmetrically transversely located relative to the underside of the vehicle, i.e., the center of gravity depicted by line 72 is centrally located between the vehicle-engaging regions of the stands and lies in a plane which passes centrally between the margins 34, 36. On the other hand, FIG. 11 illustrates a situation where one or both of the stands 20 are asymmetrically transversely located relative to the vehicle, i.e., the stand 20 of FIG. 11 is shifted rightwardly as compared with FIG. 10. However, it will be observed that, even in the asymmetrical orientation of FIG. 11, the center of gravity line 72 lies in a plane which passes between the margins 34, 36. Thus, in either case a high degree of stability is imparted to the elevated vehicle 62.

Figure 12:
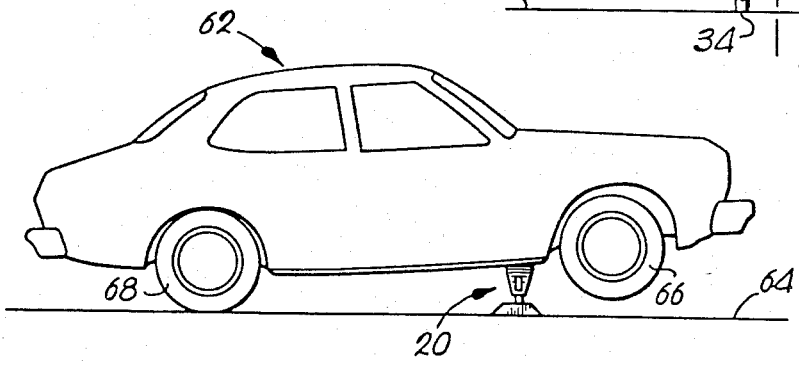
FIG. 12 is an elevational view of another use of the support of the present invention for elevating only the front portion of the vehicle while the rear wheels thereof remain in contact with the floor. Although not depicted, it is understood that the opposite end of the vehicle is lifted and another tiltable stand placed under that end.

FIG. 12 illustrates a further use of a stand in accordance with the invention. In this case a single stand 20 is employed immediately aft of the front wheels 66. The stand 20 is positioned by conventionally raising the front end of vehicle 62 and placing the stand beneath the vehicle in an appropriate location.

While the stand 20 in accordance with the invention has been illustrated with two separate vehicle-engaging regions 26, 28, those skilled in the art will appreciate that, for example, a single elongated structure lying along the length of beam 38, could be employed. In this instance of course, the overall structure still presents a pair of spaced apart vehicle-engaging regions which are spaced apart a distance greater than the lateral distance between the base side margins 34, 36. In a similar fashion, while base 22 has been depicted as being formed of separate feet 30, 32, a single plate or monolithic base could be employed. Numerous other alterations and modifications can also be made in the stand structure hereof, without departing from the spirit and scope of the invention.

I claim:

1. A method of elevating a four wheel vehicle off a floor, comprising the steps of:

tilting said vehicle with the tires on one side thereof engaging said floor and the tires on the other side of the vehicle elevated;

placing a vehicle support beneath the tilted vehicle, said support having a base presenting a pair of laterally spaced apart floor engaging side margins, a beam oriented with the longitudinal axis transverse to the direction of tilting of the support and being of greater length than the distance between said side margins and rigidly secured to said base with opposed end extremities of the beam extending outwardly beyond respective base margins, and a pair of laterally-spaced-apart vehicle-engaging and supporting regions adjustably carried by the beam, each of said regions being outboard of a corresponding side margin of said base;

tilting said support until the vehicle-engaging region closest said floor-engaging tires contacts the underside of the vehicle, the base margin closest said floor-engaging tires is in engagement with the floor, the remaining base margin is elevated from the floor, and the center of gravity of said vehicle lies in a plane passing between said base side margins; and causing said vehicle to become righted by reverse tilting of the vehicle and support back to a position where both of said vehicle-engaging regions engage the underside of the vehicle and both of base side margins engage said floor with said vehicle thereby being at least partially supported above the floor solely by said vehicle support.

2. The method as set forth in claim 1, including the steps of placing a pair of said vehicle supports beneath the tilted vehicle and respectively proximal to the front and rear wheels of the vehicle, tilting both of said vehicle supports as aforesaid, and reverse tilting of the vehicle and both of said supports until both of the supports assume a position wherein both of said regions of each support engage the underside of the vehicle and both of the side margins of said pair of vehicle supports engage the floor and said vehicle is completely elevated above the floor and is supported by the vehicle supports.

* * * * *

UNITED STATES PATENT AND TRADEMARK OFFICE

CERTIFICATE OF CORRECTION

PATENT NO. : 4,534,543

DATED : August 13, 1985

INVENTOR(S) : Joseph L. Gray

It is certified that error appears in the above-identified patent and that said Letters Patent is hereby corrected as shown below:

On the cover page, the name of the assignee reading "Gray Manufacturing Company, Inc." should read --Gray Automotive Products Co. --.

Signed and Sealed this

*Twenty-fourth* Day of *December 1985*

[SEAL]

*Attest:*

DONALD J. QUIGG

*Attesting Officer*

*Commissioner of Patents and Trademarks*